United States Patent [19]

Murasaki et al.

[11] Patent Number: 4,974,561

[45] Date of Patent: Dec. 4, 1990

[54] LUBRICATION DEVICE FOR ENGINE

[75] Inventors: Akira Murasaki, Yokohama; Masayuki Hashimoto, Kanagawa; Nobuhisa Jingu, Yokohama, all of Japan

[73] Assignees: Nissan Motor Co., Ltd., Yokohama; Nissan Kohki Co., Ltd., Kanagawa, both of Japan

[21] Appl. No.: 436,879

[22] Filed: Nov. 15, 1989

[30] Foreign Application Priority Data

Nov. 16, 1988 [JP] Japan ..... 63-149499[U]

[51] Int. Cl.[5] ..... F01L 1/04

[52] U.S. Cl. ..... 123/90.31; 123/196 R; 123/196 M; 123/90.34

[58] Field of Search ..... 123/90.31, 90.34, 196 R, 123/196 M

[56] References Cited

U.S. PATENT DOCUMENTS

| | | | |
|---|---|---|---|
| 3,352,293 | 11/1967 | Hulten | 123/90.34 |
| 4,122,818 | 10/1978 | Hattori | 123/196 M |
| 4,741,299 | 5/1988 | Matsuura et al. | 123/90.33 |
| 4,840,149 | 6/1989 | Fujita | 123/90.34 |
| 4,915,066 | 4/1990 | Koshimoto et al. | 123/90.31 |

OTHER PUBLICATIONS

Nissan FJ20 Engine Maintenance Manual, published by Nissan Corporation, Mar. 1982, pp. 5–6.

*Primary Examiner*—E. Rollins Cross

*Attorney, Agent, or Firm*—Foley, Lardner, Schwartz, Jeffery, Schwaab, Mack, Blumenthal & Evans

[57] ABSTRACT

In an engine having a camshaft mounted on a cylinder head via plural camshaft supporting portions; a camshaft sprocket coaxially coupled to the camshaft; an idler sprocket rotatably supported between the camshaft and the crankshaft on the cylinder head; a first chain reeved around the crankshaft and the idler sprocket; and a second chain reeved around the idler sprocket and the camshaft sprocket, an oil jet hole is formed in the frontmost camshaft supporting portion in communication with a main oil passage via an annular oil groove formed in the camshaft and an inclined oil groove formed in the cylinder head, so that lubricant can be sufficiently jetted from the oil jet hole to the second chain located near the frontmost camshaft supporting member, without use of an additional oil jet pipe member.

5 Claims, 4 Drawing Sheets

LUBRICATION DEVICE FOR ENGINE

BACKGROUND OF THE INVENTION

1. Field of the Invention

The present invention relates generally to a lubrication device for an engine, and more specifically to a lubrication device for supplying lubricant to a chain incorporated in a DOHC engine.

2. Description of the Prior Art

To obtain higher engine performance in automotive vehicles, DOHC (double overhead camshaft) engines have been widely used, in which two different camshafts for driving intake and exhaust valves independently are mounted on a cylinder head. In some DOHC engines, an idler sprocket (an intermediate gear) is arranged between a crankshaft and two camshafts; a first chain is reeved around the crankshaft and the idler sprocket; and a second chain is reeved around the idler sprocket and the two camshafts. During engine running, the idler sprocket is driven by the crankshaft via the first chain, and the two camshafts are driven by the idler sprocket via the second chain.

In the above-mentioned DOHC engine, however, since the second chain is located farther frontward away from the front end surface of the cylinder head or the block than the first chain, conventionally a separate oil passage for supplying oil only to the second chain is additionally formed in the cylinder block and further an oil jet pipe member is additionally pressure fitted to a hole formed on the front end surface of the cylinder block near the second chain, in order to jet lubricant to the second chain, as disclosed in NISSAN FJ20 ENGINE MAINTENANCE MANUAL, on pages 5 and 6, published by NISSAN Corp. in March, 1982, with a result that a complicated lubrication device is provided for the cylinder block of a DOHC engine.

SUMMARY OF THE INVENTION

With these problems in mind, therefore, it is the primary object of the present invention to provide a lubrication device for an engine by which lubricant can be sufficiently jetted to a chain located frontward away from the front end surface of the cylinder head or block without use of any oil jet pipe member.

To achieve the above-mentioned object, in an engine having: a least one camshaft (50) mounted on a cylinder head (100) via a plurality of camshaft supporting portions (20); a cranshaft supported by a cylinder block (200); at least one camshaft sprocket (51) coaxially coupled to the at least one camshaft; an idler sprocket (60) rotatably supported between the camshaft and the crankshaft and on the cylinder head; a first chain (68) reeved around the crankshaft and the idler sprocket to rotate the idler sprocket by the crankshaft; and a second chain (69) reeved around the idler sprocket and the camshaft sprocket to rotate the camshaft sprocket by the idler sprocket, a lubrication device according to the present invention comprises: (a) a main oil passage (150) formed in the cylinder head, for passing lubricant pressurized by an oil pump; (b) an oil passage (151) formed in the frontmost camshaft supporting portion in communication with said main oil passage; (c) an annular oil groove (50A) formed in the camshaft at a frontmost camshaft journal portion (**50*a*) between the camshaft and the camshaft supporting portion in communication with said oil passage; (d) at least one radial oil passage (50B) formed in the camshaft in communication with said annular oil passage; (e) an axial oil passage (50C) formed in the camshaft in communication between said radial oil passage and said main oil passage; and (f) an oil jet hole (152**) formed in the frontmost camshaft supporting portion in communication with said annular oil groove, for jetting lubricant therethrough toward the second chain.

Further, it is preferable to provide a diameter adjustable orifice member (152A) fittable to the oil jet hole. The lubricant jetted from the oil jet hole is applied onto the inner surface of the second chain so that newly lubricated places of the second chain are immediately brought into the mesh with the idler sprocket.

In the lubrication device for an engine according to the present invention, since the second chain reeved around the camshaft and the idler sprocket is located near the frontmost camshaft supporting portion and further the oil jet hole is formed in the frontmost camshaft supporting portion, it is possible to reduce the distance between the oil jet hole and the second chain, thus providing a sufficient lubrication application onto the second chain, without use of an additional oil jet pipe member.

DETAILED DESCRIPTION OF THE PREFERRED EMBODIMENTS

An embodiment of the lubrication device for an DOHC engine according to the present invention will be described hereinbelow with reference to the attached drawings, by way of example.

Figure 1:
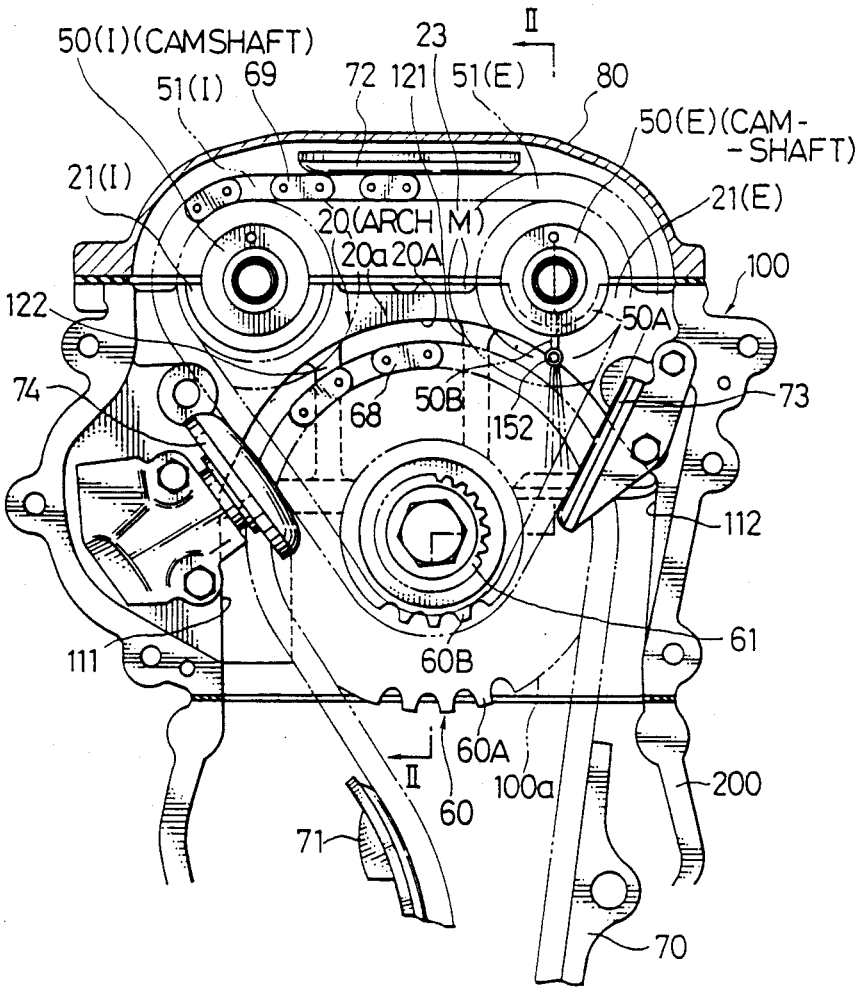
FIG. 1 is a front view showing a cylinder head and a two-camshaft driving mechanism mounted on the front end of the cylinder head, to which the lubrication device according to the present invention is applied.
Figure 2:
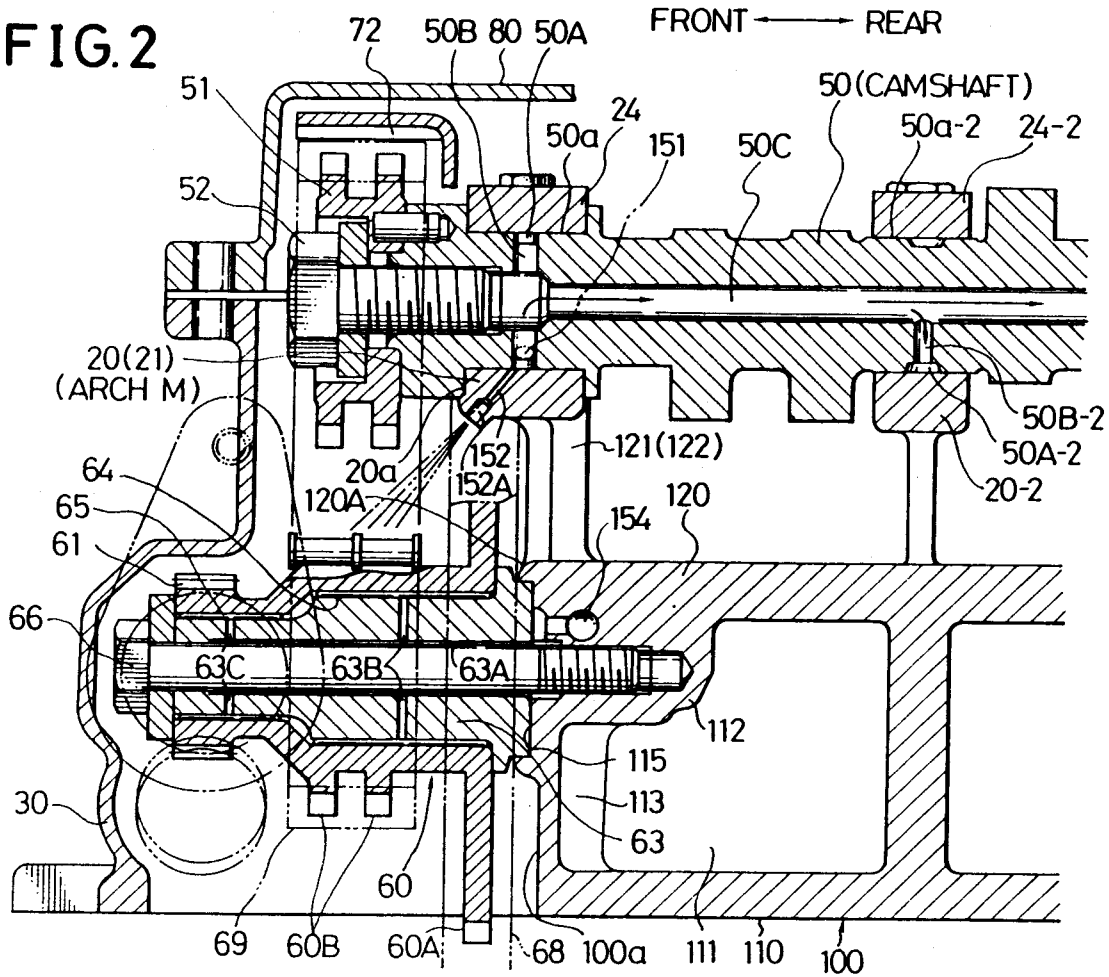
FIG. 2 is a partial cross-sectional view taken along the line II—II in FIG. 1.

With reference to FIGS. 1 and 2, a two-camshaft driving mechanism arranged at the front end of a cylinder head 100 will first be described. An idler sprocket 60 is provided between two camshaft 50 and a crankshaft (not shown) attached to a cylinder block 200 (FIG. 2).

The idler sprocket 60 is driven by the crankshaft via a first chain 68; the two camshafts 50 are driven by the idler sprocket 60 via a second chain 69; and a distributer unit (not shown) is driven by a distributer driving gear 61 fixed to the idler sprocket 60. In addition, the distributer unit is mounted at any desired inclination angle on the front cover (not shown) for covering the idler sprocket 60.

In more detail, an intake camshaft 50(I) is supported at the intake camshaft bearing portion 21(I) of an arch member 20 formed integral with the cylinder head 100. An exhaust camshaft 50(E) is supported at the exhaust camshaft bearing portion 21(E) of the same arch member 20. Intake valves (not shown) are driven open or closed by the intake camshaft 50(I) and exhaust valves (not shown) are driven open or closed by the exhaust camshaft 50(E). An intake camshaft sprocket 51(I) having two sprocket wheels is fixed to the intake camshaft 50(I) by a bolt 52(I) and similarly an exhaust camshaft sprocket 51(E) having two sprocket wheels is fixed to the exhaust camshaft 50(E) by a bolt 52(E).

Under the two camshafts 50(I) and 50(E), an idler sprocket 60 and a helical distributer driving gear 61 are rotatably supported by an idler shaft 63 (fitted to a recess 115 formed in the cylinder head 100) via two bearing members (bushed) 64 and 65, respectively. The idler sprocket 60, the helical distributer driving gear 61 and the idler shaft 63 are all attached together to the cylinder head 100 with a bolt 66. The idler sprocket 60 is formed with a first sprocket (large diameter) chain wheel 60A and two second sprocket (small diameter) chain wheels 60B. In this embodiment shown in FIG. 2, the helical distributer driving gear 61 is formed integral with the idler sprocket 60. The helical distributer driving gear 61 is engaged with helical distributer driven gear (not shown) of a distributer unit (not shown).

The first sprocket chain wheel 60A is driven by the crankshaft (not shown), because a first chain 68 is reeved around a crankshaft chain wheel (not shown) and the first sprocket chain wheel 60A. Further, the two intake and exhaust camshaft sprockets 51(I) and 51(E) are driven by the idler sprocket 60 in synchronism with the crankshaft, because a second chain 69 is reeved around the two second sprocket chain wheels 60B and the two sprocket wheels 51 of each of the intake and exhaust camshafts 50(I) and 50(E).

As shown in FIG. 1, the first chain 68 is guided by a first chain guide 70, and an appropriate tension is applied to the first chain 68 by a first chain tensioner 71. In the same way, the second chain 69 is guided by two second chain guides 72 and 73, and an appropriate tension is applied to the second chain 69 by a second chain tensioner 74. Further, the first chain 68 is arranged under the arch member 20 near and along an inner arcuate wall surface 20A thereof formed so as to extend from the two inner side surfaces 111 and 112 of the cylinder head 100.

Further, as shown in FIG. 2, the front cover 30 is fixed to the front end surface of the cylinder head 100 with bolts, and further a rocker cover 80 is fixed to the upper surfaces of the cylinder head 100 and the front cover 30.

In operation, when the engine is running, since the crankshaft (not shown) is rotated, the idler sprocket 60 is driven by the crankshaft via the first chain 68, so that the intake and exhaust camshaft sprockets 51(I) and 51(E) are driven by the idler sprocket 60 via the second chain 69 to open and close intake and exhaust valves at proper timing. On the other hand, since the helical distributer driving gear 61 is formed integral with the idler sprocket 60, the distributer unit is driven by the helical distributer driven gear in mesh with the helical distributer driving gear 61, so that ignition plugs provided for engine cylinders are ignited in sequence by a high tension (volt) generated by the distributer unit driven as described above.

A complicated structure of the cylinder head 100 will now be explained below. With reference to FIG. 2, the cylinder head 100 is formed with a lower deck 110 fixed to a cylinder block 200 (FIG. 1) and an upper deck 120. A water jacket 111 is also formed between the lower deck 110 and the upper deck 120.

An idler sprocket boss portion 112 (to which the bolt 66 for mounting the idler sprocket 60 to the cylinder head 100) is formed between the lower deck 110 and the upper deck 120. Further a rib 113 is formed between the lower deck 110 and the idler sprocket boss portion 112 for providing a higher rigidity. Since the above boss portion 112 is formed inward away from the front end wall 100*a* of the cylinder head 100, it is possible to prevent the idler sprocket 60 from greatly projecting from the front end wall 100*a* of the cylinder head 100, thus reducing the engine size. Further, since the above boss portion 112 is formed remote from the combustion chamber (not shown), it is possible to prevent the idler sprocket 60 from being heated.

On the front upper portion of the cylinder head 100, the arch member 20 including the intake bearing portion 21(I) for rotatably supporting the intake camshaft 50(I) and the exhaust bearing portion 21(E) for rotatably supporting the exhausts camshaft 50(E) is formed integral with the cylinder head 100. This arch member 20 is formed with an inner arcuate surface 20A extending from the left side wall 111 and the right side wall 112 of the cylinder head 100. Under the arch member 20, the first chain 68 reeved around the idler sprocket 60 is disposed being spaced from the inner arcuate surface 20A thereof. A front cylinder head wall 100*a* connecting the lower deck 110 and the upper deck 120 is located a little rearward away from a front arch member wall 20*a* so that the idler sprocket 60 and the first chain 68 can be accommodated deep under the arch member 20.

As shown in FIG. 1, a recessed portion 23 is formed on the upper surface of the arch member 20 to fix two bearing caps 24 (FIG. 2). Further, two boss portions having threaded holes for fixing the bearing caps 24 with bolts, respectively are formed in the recessed portion 23 of the arch member 20.

Figure 3:
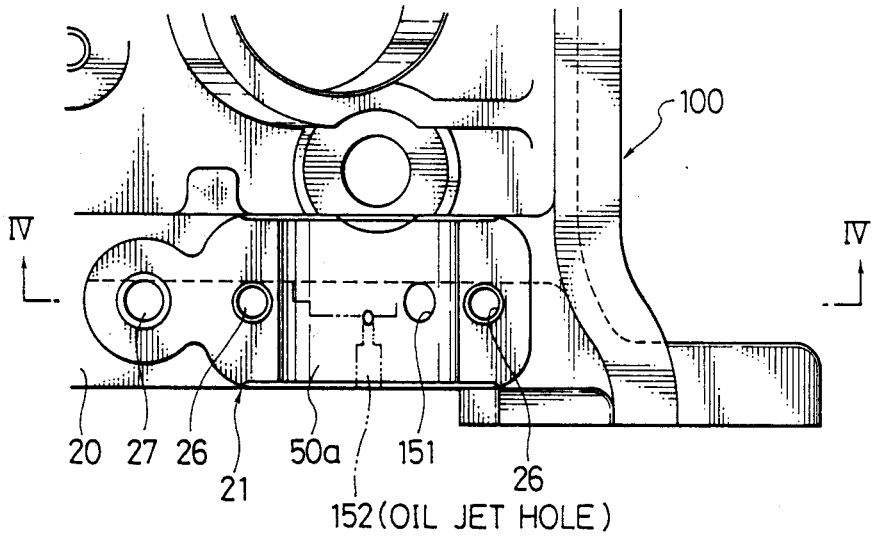
FIG. 3 is an enlarged partial top view showing the exhaust camshaft bearing portion of the cylinder head.
Figure 4:
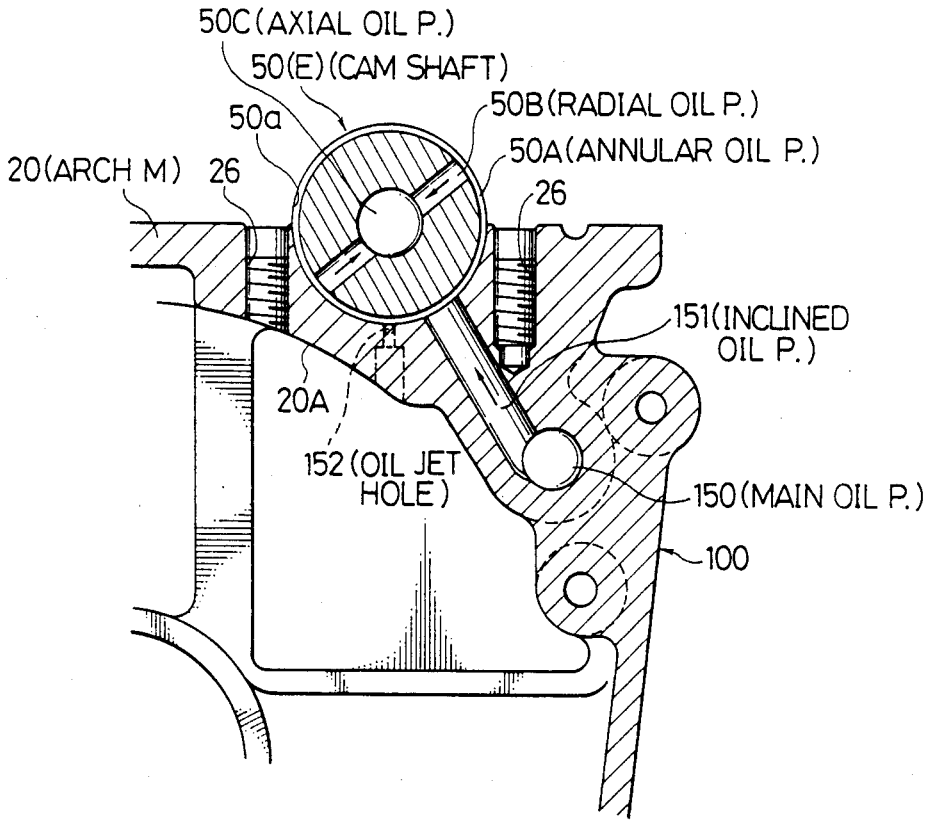
FIG. 4 is a cross-sectional view taken along the line IV—IV in FIG. 3.

With reference to FIGS. 3 and 4, a lubrication device for the exhaust camshaft 50(E) will be described. A main oil passage 150 is formed in the cylinder head 100 along the longitudinal direction thereof, through which lubricant pressurized by an oil pump (not shown) is circulated. An inclined oil passage 151 is also formed in the cylinder head 100 in communication between the main oil passage 150 and an annular oil groove 50A formed in the camshaft 50(E) at the camshaft journal portion 50*a* (FIG. 2) between the camshaft 50 and the arch member 20 or the bearing cap 24. Further, Two radial oil passages 50B (FIG. 4) and an axial oil passage 50C (FIG. 2) are formed in the camshaft 50 so as to communicate with each other.

Therefore, lubricant pressurized by an oil pump is circulated from the main oil passage 150 to the axial oil passage 50C of the camshaft 50 by way of the inclined oil passage 151 formed in the cylinder head 100, and the annular oil groove 50A and the radial oil passages 50B both formed in the camshaft 50 to lubricate the camshaft journal portion 50*a* between the camshaft 40 and the arch member 20 or the bearing cap 24. Further, since the axial oil passage 50C is formed along the axis of the camshaft 50, another camshaft journal portion 50*a*-2 between the camshaft 50 and another bearing cap 24-2 or another arch member 20-2 arranged adjacent to the frontmost bearing cap 24 or the arch member 20 can be lubricated. In the same way, other camshaft journal portions (not shown) can be lubricated by lubricant passing through the axial oil passage 50C of the camshaft 50.

The lubrication device of the intake camshaft 50(I) is substantially the same as that of the exhaust camshaft 50(E). Further, in FIGS. 3 and 4, reference numerals 26 and 27 denote threaded holes formed in the arch member 20 to fix the bearing cap 24 to the arch member 20 with bolts.

The feature of the present invention is to form an inclined oil jet hole 152 in the arch member 20 of the cylinder head 100 under the camshaft bearing portion 21(E) so as to be oriented toward the second chain 69 in communication with the annular oil groove 50A formed in the camshaft 50(E). Therefore, lubricant supplied from the main oil passage 150 via the inclined oil passage 151 and the annular oil groove 50A can be jetted toward the second chain 69 through the inclined oil jet hole 152 obliquely from above.

During the engine running, the idler sprocket 60 is driven by the crankshaft (not shown) via the first chain 68, and therefore the two camshaft sprockets 51 are driven by the idler sprocket 60 via the second chain 69, thus lubrication being required for the second chain 69.

In the lubricant device according to the present invention, since the inclined oil jet hole 152 is formed in the arch member 20 located at the frontmost end of the cylinder head 100, it is possible to minimize the distance between the inclined oil jet hole 152 and the second chain 69 reeved around the exhaust camshaft sprocket 51(E). Therefore, it is possible to reliably jet lubricant toward the second chain 69 without additionally pressure fitting an oil jet pipe member into the cylinder head. In lubricant application, it is preferable to jet lubricant onto the inner surface of the second chain 69 so that the newly lubricated places are immediately brought into mesh with the two second sprocket chain wheels 60B of the idler sprocket 60 for driving the second chain 69.

Further, as another modification, it is also preferable to pressure fit a diameter adjustable orifice member 152A (FIG. 2) into the inclined oil jet hole 152 so that the amount of lubricant can be adjusted.

Further, another oil passage 154 (FIG. 2) communicating with the main oil passage 150 is formed in the upper deck 120 of the cylinder head 100 so that lubricant can be supplied to the two bearing members (bushes) 64 and 65 of the idler sprocket 60 via a gap 63A formed between the idler shaft 63 and the bolt 66 and plural radial oil passages 63B and 63C formed in the idler shaft 63.

In the above-mentioned construction, when lubricant is jetted from the inclined oil jet hole 152, the chain chamber covered by the front cover 30 is filled with lubricant spray. The lubricant fed into the chain chamber as described above partly flows downward along the inner wall surfaces of the cylinder head 100 and the cylinder block 200, and partly sticks onto the second chain 69, the camshaft sprockets 51, the idler sprocket 60, the distributer gear 61, and the first chain 68 for lubrication, being partly scattered by high-speed rotating elements such as the camshaft sprockets, the idler sprocket, the gears, etc.

In this case, since the arch member 20 is located frontward away from the font end surface 120A (FIG. 2) of the upper deck 120, lubricant flowing from the camshaft 50 or other elements can be smoothly returned to an oil pan by gravity along the upper deck front end surface 120A and the front end surface 100*a* of the cylinder head 100, without lubricant accumulation.

Furthermore, since the two camshafts 50 are supported by the arch member 20, it is possible to arrange the first chain sprocket wheel 60A near and along the inner arcuate surface 20A of the arch member 20, thus reducing the total length of a DOHC engine.

As described above, in the lubricant device for a DOHC engine according to the present invention, since an inclined oil jet hole 152 is formed in the arch member 20 located at the frontmost end of the cylinder head and just under the camshaft journal portion 50*a* so as to communicate with the main oil passage 150 via the inclined oil passage 151 and the annular oil groove 50A formed in the camshaft 50, it is possible to form the oil jet hole 152 in the vicinity of the second chain 69 for providing a reliable chain and sprocket lubrication, without use of an additional oil jet pipe member, thus facilitating the structure of the lubrication device for a DOHC engine.

What is claimed is:

1. A lubrication device for an engine having:

at least one camshaft mounted on a cylinder head via a plurality of camshaft supporting portions;

a crankshaft supported by a cylinder block;

at least one camshaft sprocket coaxially coupled to the at least one camshaft;

an idler sprocket rotatably supported between the camshaft and the crankshaft and on the cylinder head;

a first chain reeved around the crankshaft and the idler sprocket to rotate the idler sprocket by the crankshaft; and a second chain reeved around the idler sprocket and the camshaft sprocket to rotate the camshaft sprocket by the idler sprocket; wherein the lubrication device comprises:

(a) a main oil passage formed in the cylinder head, for passing lubricant pressurized by an oil pump;

(b) an oil passage formed in the frontmost camshaft supporting portion in communication with said main oil passage;

(c) an annular oil groove formed in the camshaft at a frontmost camshaft journal portion between the camshaft and the camshaft supporting portion in communication with said oil passage;

(d) at least one radial oil passage formed in the camshaft in communication with said annular oil passage;

(e) an axial oil passage formed in the camshaft in communication between said radial oil passage and said main oil passage; and (f) an oil jet hole formed in the frontmost camshaft supporting portion in communication with said annular oil groove, for jetting lubricant therethrough toward the second chain.

2. The lubrication device for an engine of claim 1, which further comprises a diameter adjustable orifice member fittable to said oil jet hole, for adjusting the quantity of lubricant jetted toward the second chain.

3. The lubrication device for an engine of claim 1, wherein lubricant is jetted from said oil jet hole to an inner surface of the second chain so that newly lubricated places of the second chain are immediately brought into mesh with the idler sprocket.

4. The lubrication deviice for an engine of claim 1, wherein the frontmost camshaft supporting portion at which said oil jet hole is formed is located frontward away from a front end surface of the cylinder head to allow lubricant to smoothly flow from the camshaft to an oil pan along the front end surface of the cylinder head by gravity without lubricant accumulation.

5. The lubrication device for an engine of claim 1, which further comprises another oil passage formed in the cylinder head in communication with said main oil passage, for supplying lubricant to a bearing portion of the idler sprocket.

* * * * *